US009693670B2

(12) United States Patent
Dries

(10) Patent No.: US 9,693,670 B2
(45) Date of Patent: Jul. 4, 2017

(54) FILTER ASSEMBLY FOR A DISHWASHER APPLIANCE

(71) Applicant: General Electric Company, Schenectady, NY (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 231 days.

(21) Appl. No.: 14/597,289

(22) Filed: Jan. 15, 2015

(65) Prior Publication Data

US 2016/0206174 A1 Jul. 21, 2016

(51) Int. Cl.
*A47L 15/42* (2006.01)

(52) U.S. Cl.
CPC ..... *A47L 15/4208* (2013.01); *A47L 15/4202* (2013.01); *A47L 15/4206* (2013.01); *A47L 15/4225* (2013.01)

(58) Field of Classification Search
CPC ..... A47L 15/4208; A47L 15/4202; A47L 15/4204; A47L 15/4206
USPC ..... 134/56 D, 57 D, 58 D, 104.1
See application file for complete search history.

(56) References Cited

U.S. PATENT DOCUMENTS

| | | | | |
|---|---|---|---|---|
| 2,808,063 | A | 10/1957 | Albresch et al. | |
| 3,179,116 | A * | 4/1965 | Jacobs | A47L 15/4206 134/104.1 |
| 3,217,884 | A | 11/1965 | Long | |
| 3,370,598 | A * | 2/1968 | Lopp | A47L 15/4202 134/111 |
| 3,487,931 | A * | 1/1970 | Paulson | B01D 29/46 210/130 |
| 5,900,070 | A * | 5/1999 | Jarvis | A47L 15/4204 134/104.4 |
| 5,937,879 | A * | 8/1999 | Payzant | A47L 15/4206 134/104.1 |
| 7,980,256 | B2 | 7/2011 | Hartvigsson | |
| 2014/0158168 | A1* | 6/2014 | Thiyagarajan | A47L 15/4206 134/104.2 |

* cited by examiner

*Primary Examiner* — Michael Wieczorek
*Assistant Examiner* — Kevin G Lee
(74) *Attorney, Agent, or Firm* — Dority & Manning, P.A.

(57) ABSTRACT

A dishwasher appliance including a tub defining a wash chamber is provided. The dishwasher appliance also includes a sump positioned at a bottom portion of the tub, the sump including a bottom wall that defines a recessed chamber. A drain pump is provided in flow communication with the recessed chamber defined by the bottom wall of the sump. Moreover, a filter assembly is positioned at least partially within the sump and movable along an axial direction of the sump between a first position and a second position. The filter assembly is positioned over the recessed chamber of the bottom wall when in the first position and is seated on the bottom wall of the sump around the recessed chamber when in the second position.

19 Claims, 4 Drawing Sheets

FILTER ASSEMBLY FOR A DISHWASHER APPLIANCE

FIELD OF THE INVENTION

The present subject matter relates generally to dishwasher appliances, or more particularly, a filter assembly for dishwasher appliances.

BACKGROUND OF THE INVENTION

During wash and rinse cycles, dishwasher appliances generally circulate a fluid through a wash chamber over articles, such as pots, pans, silverware, etc. The fluid can be, e.g., various combinations of water and detergent during the wash cycle or water (which may include additives) during the rinse cycle. Typically, the fluid is circulated during a given cycle using a circulation pump. Fluid is collected in a sump at or near a bottom of the wash chamber and pumped back into the wash chamber through, e.g., nozzles in spray arms and other openings that direct the fluid against the articles to be cleaned or rinsed.

Depending upon the level of soil on the articles, fluids used during wash and rinse cycles will become contaminated with soils in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump.

Accordingly, dishwasher appliances generally include a filter assembly to remove such soils from the fluid. In certain dishwasher appliances, the filter assembly is configured as a cylindrical filter surrounding the circulation pump within the sump of the dishwasher appliance. However, with such a configuration certain portions of the filter can more easily or quickly become clogged or plugged up.

Therefore, a dishwasher appliance having a filter assembly capable of unclogging at least a portion of the filter assembly would be useful. Moreover, a dishwasher appliance having a filter assembly capable of purging at least a portion of the filter at least one per wash cycle would be particularly beneficial.

BRIEF DESCRIPTION OF THE INVENTION

Aspects and advantages of the invention will be set forth in part in the following description, or may be apparent from the description, or may be learned through practice of the invention.

In a first exemplary embodiment, a dishwasher appliance is provided defining a vertical direction. The dishwasher appliance includes a tub defining a wash chamber and a sump positioned at a bottom portion of the tub along the vertical direction. The sump includes a bottom wall defining a recessed chamber and the sump defines an axial direction. The dishwasher appliance additionally includes a drain pump in flow communication with the recessed chamber of the bottom wall and a filter assembly. The filter assembly is movably positioned at least partially within the sump along the axial direction between a first position and a second position. The filter assembly is spaced from the recessed chamber of the bottom wall of the sump along the axial direction when in the first position and is seated on the bottom wall of the sump around the recessed chamber when in the second position.

In a second exemplary embodiment, a dishwasher appliance is provided defining a vertical direction. The dishwasher appliance includes a tub defining a wash chamber and a sump positioned at a bottom portion of the tub along the vertical direction. The sump includes a bottom wall defining a recessed chamber and defines an axial direction. The dishwasher appliance additionally includes a drain pump in flow communication with the recessed chamber of the bottom wall for urging a flow of wash fluid from the sump when activated and a filter assembly. The filter assembly is positioned at least partially within the sump and is movable along the axial direction between a first position and a second position. The filter assembly includes a bottom panel, the bottom panel positioned over the recessed chamber of the bottom wall of the sump when the filter assembly is in the first position and seated on the bottom wall of the sump around the recessed chamber when the filter assembly is in the second position. A flow of wash fluid is reversed through at least a portion of bottom panel when the filter assembly is in the second position and the drain pump is activated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
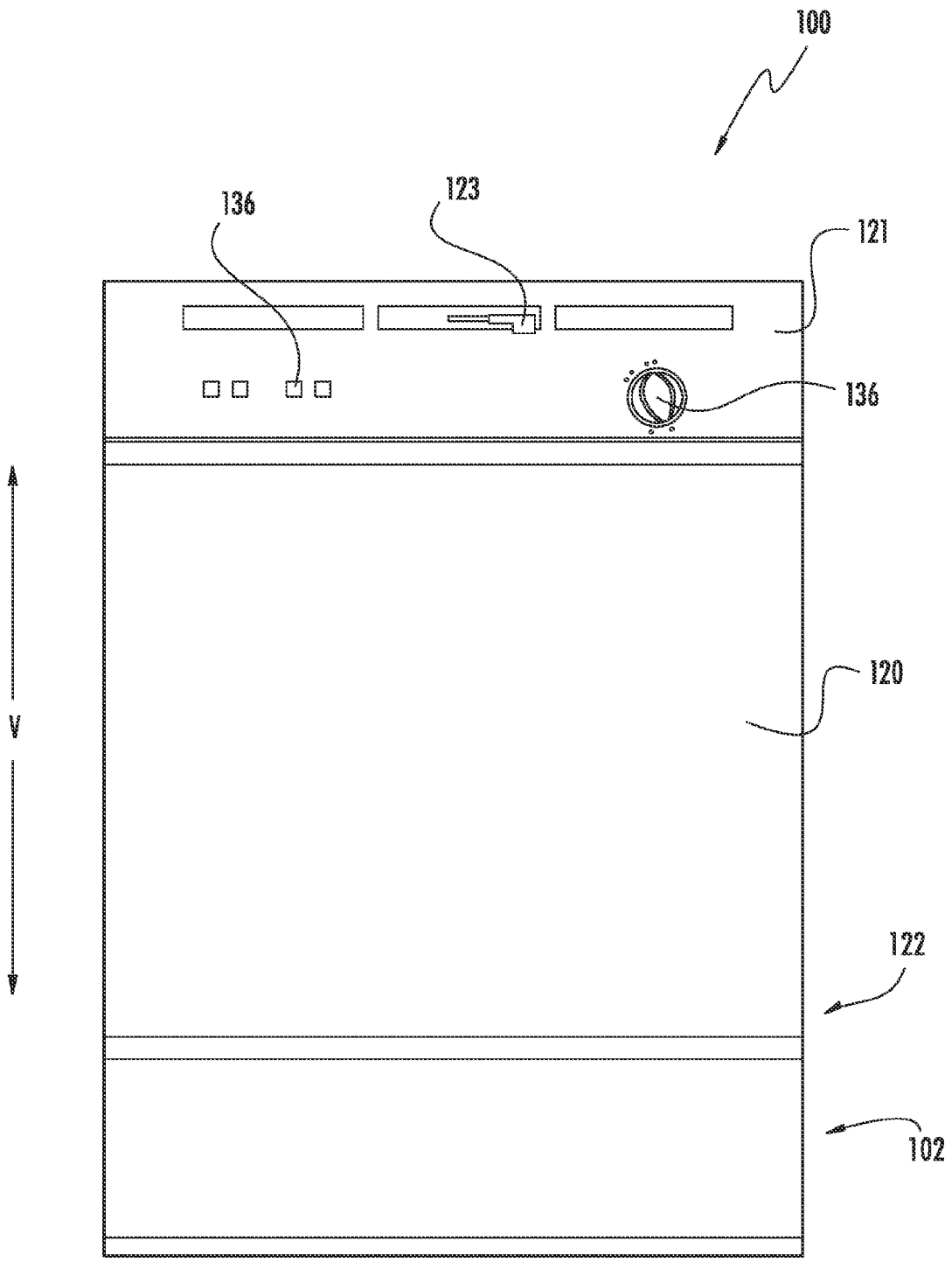
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
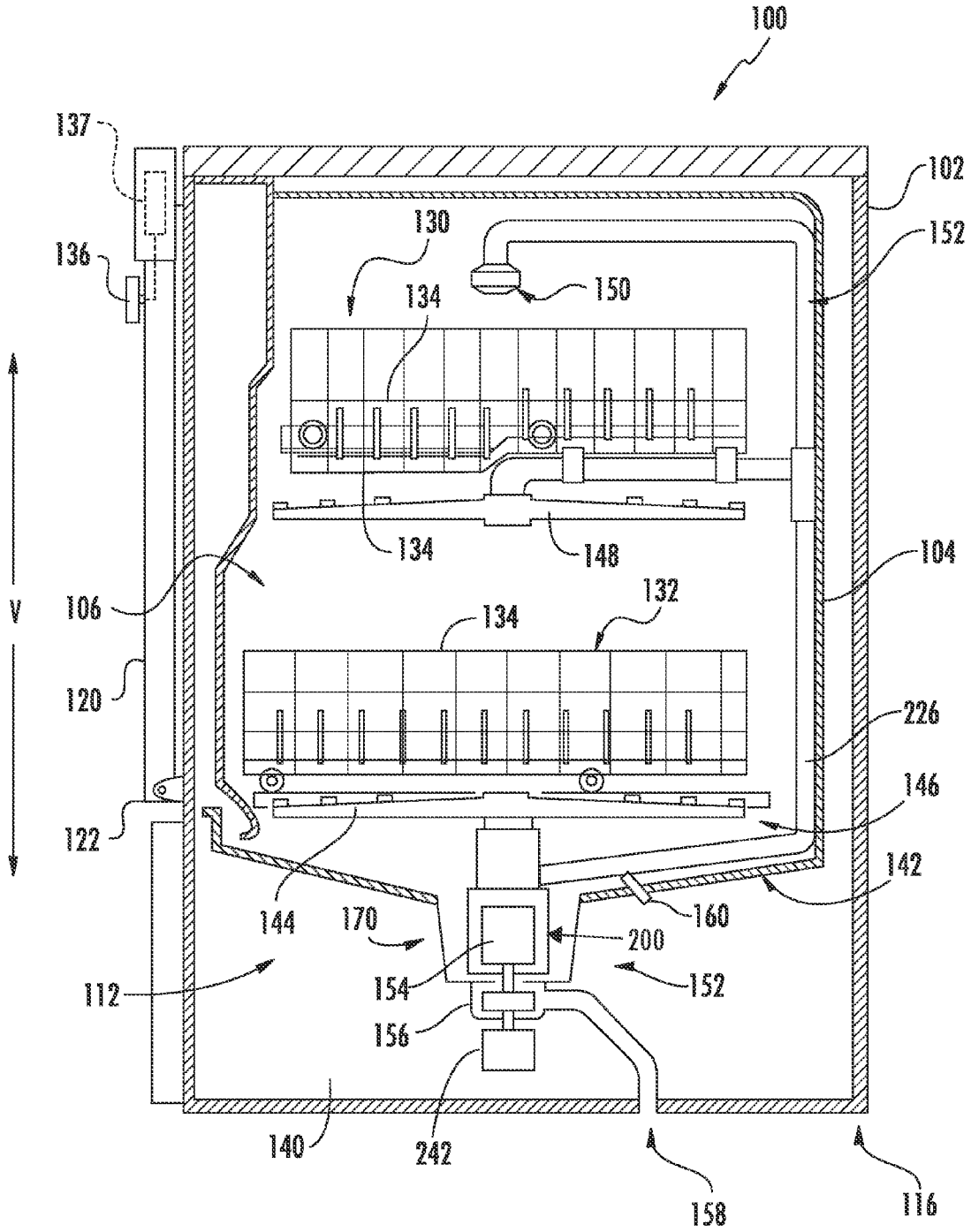
FIG. 2 provides a side, section view of the exemplary dishwasher appliance of FIG. 1.

FIGS. 1 and 2 depict a dishwasher appliance 100 according to an exemplary embodiment of the present subject matter. As shown in FIG. 1, dishwasher appliance 100 includes a cabinet 102. Cabinet 102 has a tub 104 therein that defines a wash compartment 106. The tub 104 also defines a front opening (not shown). Dishwasher appliance 100 includes a door 120 hinged at a bottom 122 of door 120 for movement between a normally closed, vertical position (shown in FIGS. 1 and 2), wherein wash compartment 106 is sealed shut for washing operation, and a horizontal, open position for loading and unloading of articles from dishwasher appliance 100. Latch 123 is used to lock and unlock door 120 for access to wash compartment 106. Tub 104 also includes a sump 170 positioned adjacent a bottom portion 112 of tub 104 and configured for receipt of a liquid wash fluid (e.g., water, detergent, wash fluid, and/or any other suitable fluid) during operation of dishwasher appliance 100.

A spout 160 is positioned adjacent sump 170 of dishwasher appliance 100. Spout 160 is configured for directing liquid into sump 170. Spout 160 may receive liquid from, e.g., a water supply (not shown) or any other suitable source. In alternative embodiments, spout 160 may be positioned at any suitable location within dishwasher appliance 100, e.g, such that spout 160 directs liquid into tub 104. Spout 160 may include a valve (not shown) such that liquid may be selectively directed into tub 104. Thus, for example, during the cycles described below, spout 160 may selectively direct water and/or wash fluid into sump 170 as required by the current cycle of dishwasher appliance 100.

Rack assemblies 130 and 132 are slidably mounted within wash compartment 106. Each of the rack assemblies 130 and 132 is fabricated into lattice structures including a plurality of elongated members 134. Each rack of the rack assemblies 130 and 132 is adapted for movement between an extended loading position (not shown) in which the rack is substantially positioned outside the wash compartment 106, and a retracted position (shown in FIGS. 1 and 2) in which the rack is located inside the wash compartment 106. A silverware basket (not shown) may be removably attached to rack assembly 132 for placement of silverware, utensils, and the like, that are otherwise too small to be accommodated by the racks 130 and 132.

Dishwasher appliance 100 further includes a lower spray assembly 144 that is rotatably mounted within a lower region 146 of the wash compartment 106 and above sump 170 so as to rotate in relatively close proximity to rack assembly 132. A mid-level spray assembly 148 is located in an upper region of the wash compartment 106 and may be located in close proximity to upper rack 130. Additionally, an upper spray assembly 150 may be located above the upper rack 130.

The lower and mid-level spray assemblies 144 and 148 and the upper spray assembly 150 are fed by a fluid circulation assembly 152 for circulating water and dishwasher fluid in the tub 104. Fluid circulation assembly 152 may include a wash or circulation pump 154 and a cross-flow/drain pump 156. As will be discussed in greater detail below, circulation pump 154 is positioned at least partially in sump 170 and drain pump is positioned below sump 170 in flow communication with sump 170. Additionally, drain pump 156 is configured for urging the flow of wash fluid from sump 170 to a drain 158 when activated. By contrast, circulation pump 154 is configured for supplying a flow of wash fluid from sump 170 to spray assemblies 144, 148 and 150 by way of one or more circulation conduits 226 when activated. Moreover, a filter assembly 200 is also positioned at least partially in sump 170 for filtering food particles or other debris, referred to herein generally as soils, from wash fluid prior to such wash fluid flowing to circulation pump 154.

Spray assemblies 144 and 148 include an arrangement of discharge nozzles or orifices for directing wash fluid onto dishes or other articles located in rack assemblies 130 and 132. The arrangement of the discharge nozzles in spray assemblies 144 and 148 provides a rotational force by virtue of wash fluid flowing through the discharge ports. The resultant rotation of the spray assemblies 144 and 148 provides coverage of dishes and other dishwasher contents with a spray of wash fluid.

Dishwasher appliance 100 is further equipped with a controller 137 (shown in phantom) to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated embodiment, controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, controller 137 includes a user interface panel 136 through which a user may select various operational features and modes and monitor progress of the dishwasher appliance 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the subject matter disclosed herein is not limited to any particular style, model or configuration of dishwasher appliance, and that the embodiment depicted in FIGS. 1 and 2 is for illustrative purposes only. For example, instead of the racks 130 and 132 depicted in FIG. 1, dishwasher appliance 100 may be of a known configuration that utilizes drawers that pull out from the cabinet and are accessible from the top for loading and unloading of articles.

Figure 3:
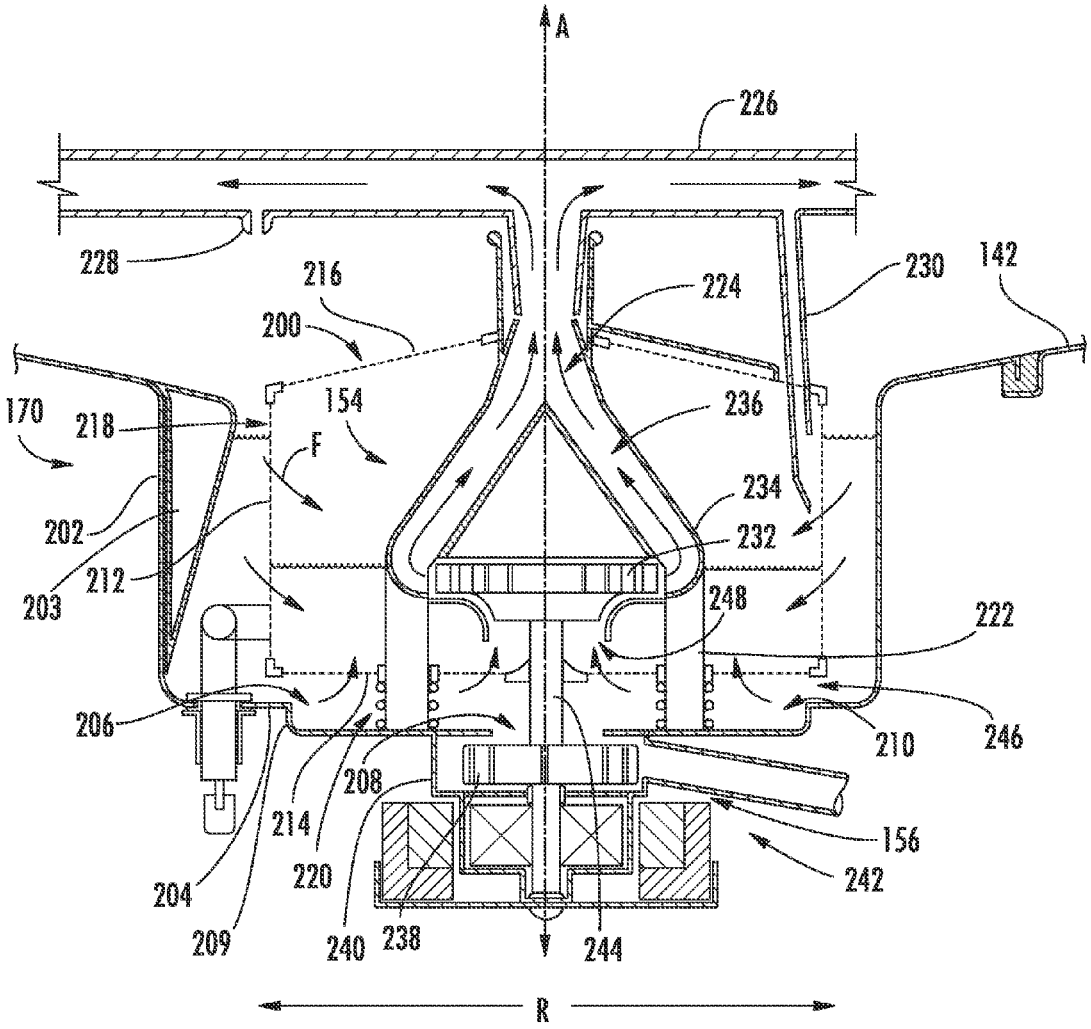
FIG. 3 provides a cross-sectional view of a sump of the exemplary dishwasher appliance of FIG. 1 with a filter assembly in a first position.
Figure 4:
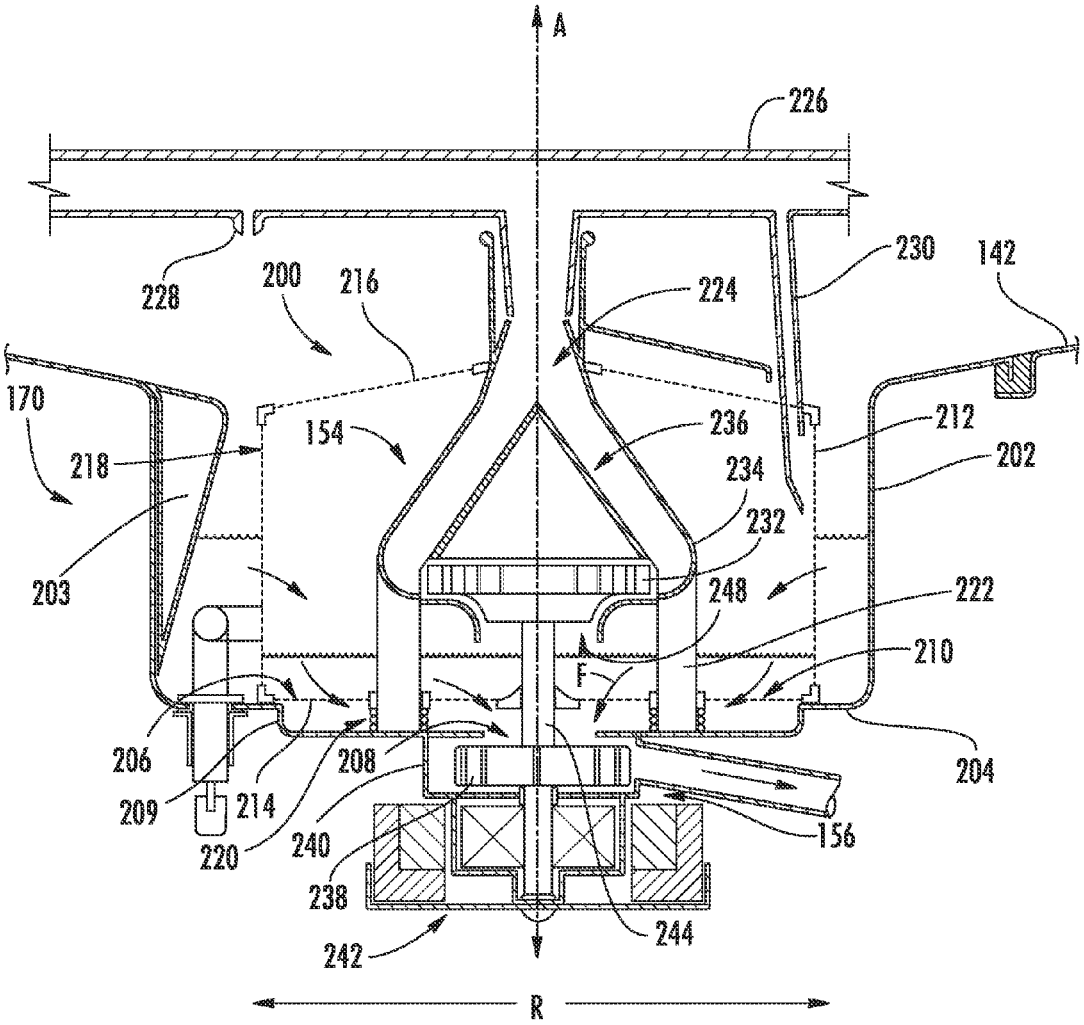
FIG. 4 provides a cross-sectional view of the sump of the exemplary dishwasher appliance of FIG. 1 with the filter assembly in a second position.

Referring now to FIGS. 3 and 4, close up cross-sectional views of sump 170 of the exemplary dishwasher appliance 100 of FIG. 1 are provided. More particularly, FIG. 3 provides a side cross-sectional view of the sump 170 of the exemplary dishwasher appliance 100 of FIG. 1 with the filter assembly 200 in a first position, and FIG. 4 provides a side cross-sectional view of the sump 170 portion of the exemplary dishwasher appliance 100 of FIG. 1 with the filter assembly 200 in a second position.

As stated, sump 170 is positioned at a bottom portion 112 of tub 104 along the vertical direction V. Sump 170 defines an axial direction A and a radial direction R. For the embodiment depicted, the axial direction A is parallel to the vertical direction, and sump 170 is formed integrally with a bottom wall 142 of tub 104. However, in other embodiments, sump 170 may instead be formed separately from bottom wall 142 of tub 104 and attached to bottom wall 142 of tub 104 in any suitable manner. Additionally, sump 170 may have any other suitable orientation.

Sump 170 includes a side wall 202 and a bottom wall 204. Sidewall 202 may define a substantially cylindrical shape along the axial direction A, although in other embodiments, sidewall 202 may instead define any other suitable shape, such as a frustoconical shape, or alternatively an inverted frustoconical shape along the axial direction A. Notably, for the embodiment depicted, an attachment member 203 is positioned on sidewall 202 to modify a shape of sidewall 202 along the axial direction A. More particularly, attachment member 203 creates less separation with filter assembly 200 along the radial direction R towards a top end of sidewall 202 as compared to a bottom end of sidewall 202. Accordingly, attachment member 203 may modify a flow of wash fluid into filter assembly 200. Although attachment member 203 is depicted being separate from sidewall 202 and attached to sidewall 202, in other embodiments, attachment member 203 may be formed integrally with sidewall 202.

The exemplary bottom wall 204 extends inwardly from sidewall 202 along the radial direction R and defines a recessed chamber 206 positioned radially inward of sidewall 202. Recessed chamber 206 is defined at its perimeter by a rim portion 209 of bottom wall 204 extending downward generally along the axial direction A (or vertical direction V). Recessed chamber 206 also defines an opening 210 having a generally circular shape. Moreover, bottom wall 204 defines a drain inlet 208 in a portion that opens into the recessed chamber 206. More particularly, for the embodiment depicted, drain inlet 208 is positioned at a center of bottom wall 204, inward from rim portion 209 along the radial direction R.

Filter assembly 200 is movably positioned at least partially within sump 170 along the axial direction A. More particularly, filter assembly 200 is movable between a first position (FIG. 3) and a second position (FIG. 4). As stated, the axial direction A of sump 170 may be parallel to the vertical direction V, such that the first position is an up position in the second position is a down position. Filter assembly 200 generally includes a side panel 212, a bottom panel 214, and a top panel 216. Each of side panel 212, bottom panel 214, and top panel 216 in turn include a filter medium defining a plurality of openings or pores 218 configured to allow wash fluid to pass therethrough while preventing soils, such as food particles or other debris, larger than a predetermined size to pass therethrough. For example, in certain embodiments, one or more of side panel 212, bottom panel 214, and top panel 216 may include a fine mesh material.

As is depicted, filter assembly 200 is positioned at least partially within sump 170 over recessed chamber 206 defined by bottom wall 204 of sump 170 when in the first position. More particularly, bottom panel 214 of filter assembly 200 is positioned over recessed chamber 206 of bottom wall 204 of sump 170 when filter assembly 200 in the first position. By contrast, however, when filter assembly 200 is in the second position, filter assembly 200, or more particularly bottom panel 214 of filter assembly 200, is seated on bottom wall 204 of sump 170 around recessed chamber 206, such that a perimeter of bottom panel 214 contacts bottom wall 204 at a location outward along the radial direction R from the recessed chamber 206 defined by the bottom wall 204. More particularly, for the embodiment depicted, bottom panel 214 of filter assembly 200 defines a first diameter along the radial direction R and opening 210 of recessed chamber 206 defines a second diameter along the radial direction R. The first diameter is larger than the second diameter, such that bottom panel 214 of filter assembly 200 may effectively be seated over recessed chamber 206 in bottom wall 204 when in the second position. Further, as will be discussed in greater detail below, such a configuration allows a flow of wash fluid F to be reversed through at least a portion of bottom panel 214 of filter assembly 200 when filter assembly 200 is in the second position and drain pump 156 is activated.

Referring still to the exemplary embodiment of FIGS. 3 and 4, filter assembly 200 is biased towards the first position, and accordingly exemplary dishwasher appliance 100 includes one or more biasing members 220 configured to bias filter assembly 200 towards the first position. For the embodiment depicted, the biasing members 220 include a plurality of springs positioned between bottom wall 204 of sump 170 and bottom panel 214 of filter assembly 200. Although springs are depicted as extending along one or more support members 222 (discussed below), in other embodiments, springs may be positioned at any other suitable location. Further, in other embodiments, biasing members 220 may be any other suitable members configured to bias the filter assembly 200 towards the up position. For example, in other embodiments, the biasing members 220 may instead include any resilient material having a suitable construction. It should be appreciated, however, that in other exemplary embodiments, filter assembly 200 may not be biased towards the first position or the down position, and accordingly may not include biasing members 220.

As stated, filter assembly 200 is a generally cylindrical filter assembly 200, such that side panel 212 defines a cylindrical shape extending along the axial direction A and bottom panel 214 defines a circular shape in the radial direction R. additionally, top panel 216 includes an opening 224 in flow communication with a circulation conduit 226. Opening 224 in top panel 216 of filter assembly 200 may be configured to form a seal with circulation conduit 226 and/or circulation pump 154. Additionally, for the embodiment depicted, circulation conduit 226 additionally includes at least one downward facing nozzle 228 configured to clean an outer surface of side panel 212 of filter assembly 200 and a duct 230 extending into filter assembly 200 configured to clean an inner surface of side panel 212 of filter assembly 200. However, in other exemplary embodiments, dishwasher appliance 100 may include any other suitable mechanism(s) for cleaning side panel 212, or alternatively may not include any mechanism for cleaning side panel 212.

Circulation pump 154 is depicted positioned at least partially within filter assembly 200 and is held in position along the axial direction A by support members 222. More particularly, circulation pump 154 includes a circulation pump impeller 232 and a circulation pump housing 234. Circulation pump impeller 232 is positioned within filter assembly 200 and is enclosed by circulation pump housing 234. Circulation pump housing 234 additionally defines a plurality of diffuser veins 236 downstream of impeller 232 and in flow communication with circulation conduit 226. Diffuser veins 236 thus may direct a flow F of wash fluid from circulation pump impeller 232 to the circulation conduit 226. Moreover, the one or more support members 222 extend generally along the axial direction A between housing 234 of circulation pump 154 and bottom wall 204 of sump 170. More particularly, for the embodiment depicted, the one or more support members 222 extend from housing 234 of circulation pump 154 through recessed chamber 206 to bottom wall 204 of sump 170.

Drain pump 156 similarly includes a drain pump impeller 238 and a drain pump housing 240. Drain pump impeller 238 is enclosed by drain pump housing 240, and drain pump housing 240 is attached to sump 170. More particularly, drain pump housing 240 is positioned below and in flow communication with recessed chamber 206 defined by bottom wall 204 of sump 170 assembly through drain inlet 208 of bottom wall 204 of sump 170. In certain exemplary embodiments, drain pump housing 240 may be formed integrally with sump 170, or alternatively may be attached to sump 170 in any suitable manner.

The exemplary dishwasher appliance 100 of FIGS. 3 and 4 additionally includes an electric motor 242 and a shaft 244 rotated by the electric motor 242. Shaft 244 extends through drain pump impeller 238 and into circulation pump impeller 232 generally along the axial direction A. Shaft 244 is selectively engaged with drain pump impeller 238 and circulation pump impeller 232, such that rotation of shaft 244 rotates drain pump impeller 238 or alternatively rotates circulation pump impeller 232. More particularly, circulation pump 154 further includes a first one-way clutch (not shown) in mechanical communication with circulation pump impeller 232 and shaft 244. When shaft 244 is rotated in a first direction by electric motor 242, first one-way clutch is configured to engage circulation pump impeller 232 and rotate circulation pump impeller 232. Similarly, drain pump 156 further includes a second one-way clutch (not shown) in mechanical communication with drain pump impeller 238 and shaft 244. When shaft 244 is rotated in a second direction by electric motor 242, the second direction being an opposite direction of the first direction, second one-way clutch is configured to engage drain pump impeller 238 and rotate drain pump impeller 238. Accordingly, with such a configuration, only one of circulation pump 154 and drain pump 156 may be activated at a given time.

It should be appreciated, however, that in other exemplary embodiments, any other suitable mechanism may be provided for engaging drain pump 156 and/or circulation pump 154. For example, in other exemplary embodiments, drain pump 156 and circulation pump 154 may instead each be powered by separate electric motors.

Referring now particularly to FIG. 3, sump 170 is depicted during operation of circulation pump 154, such as during a wash or rinse cycle of the exemplary dishwasher appliance 100. During operation of circulation pump 154, filter assembly 200 is configured to be in the first position. When filter assembly 200 is in the first position, a passage 246 is defined between bottom panel 214 of filter assembly 200 and bottom wall 204 of sump 170. Passage 246 allows for wash fluid to access bottom panel 214 of filter assembly 200. Accordingly, during operation, impeller 232 of circulation pump 156 may pull a flow of wash fluid F through one or more of top panel 216, side panel 212, and bottom panel 214 of filter assembly 200, such that wash fluid may flow inwardly through side panel 212, top panel 216, and/or bottom panel 214 of filter assembly 200. It should be appreciated, that as used herein, the term "inwardly" refers to a direction originating outside of filter assembly 200 towards an inside of filter assembly 200. By contrast, the term "outwardly" refers to a direction originating within filter assembly 200 towards an outside of filter assembly 200.

As shown, with the configuration of sump 170 and filter assembly 200 depicted, soils in wash fluid may gravitate towards recessed chamber 206 defined in bottom wall 204 of sump 170. For example, an inlet 248 of circulation pump 154 is positioned adjacent bottom panel 214 of filter assembly 200, and thus wash fluid may first be pulled through bottom panel 214 of filter assembly 200. Additionally, as recessed chamber 206 is positioned at a bottom of sump 170, gravitational forces may also cause soils to gravitate towards recessed chamber 206. Such a configuration may allow for efficient draining and cleaning of sump 170, as the drain inlet 208 defined by bottom wall 204 opens into recessed chamber 206 defined by bottom wall 204 (as is discussed below). However, during operation of circulation pump 154, such a configuration may cause bottom panel 214 of filter assembly 200 to clog or plug-up with soils. As bottom panel 214 of filter assembly 200 clogs or plugs-up, less wash fluid flows through bottom panel 214 to circulation pump 154. Accordingly, recessed chamber 206 is positioned such that the soils may congregate therein and be subject to less agitation during operation of circulation pump 154 as compared to soils positioned elsewhere in sump 170. Thus, soils positioned in recessed chamber 206 may not break-up into smaller soils, which may be more difficult for filter assembly 200 to filter. Recessed chamber 206 may therefore be referred to as a "quiet" chamber.

Referring now particularly to FIG. 4, sump 170 is depicted during operation of drain pump 156, such as during a drain cycle of the exemplary dishwasher appliance 100. During operation of drain pump 156, a flow of wash fluid F may be pulled from sump 170 through recessed chamber 206 in bottom wall 204 of sump 170 and through drain pump inlet 208 of bottom wall 204. As many of the soils may be positioned in recessed chamber 206, drain pump 156 may expel the soils previously gathered in recessed chamber 206 of bottom wall 204 more quickly and may leave less soils behind for subsequent cycles.

Notably, if bottom panel 214 of filter assembly 200 has been clogged or plugged-up during a wash or rinse cycle, a resistance on the flow of wash fluid F generated by drain pump 156 through bottom panel 214 may generate a downward force on the filter assembly 200. The downward force may overcome any biasing members 220 and may move the filter assembly 200 to the down position. When filter assembly 200 is in the down position and drain pump 156 is activated, wash fluid may flow inwardly through side panel 212 and top panel 216 of filter assembly 200, but outwardly through bottom panel 214 of filter assembly 200. Such a reversed flow through bottom panel 214 of filter assembly 200 may be forced due to bottom panel 214 being seated on bottom wall 204 of sump 170 at a position outward along the radial direction R from recessed chamber 206, closing passage 246 between bottom wall 204 of sump 170 and bottom panel 214 of filter assembly 200. Such a reversed flow through bottom panel 214 of filter assembly 200 may purge bottom panel 214, removing any clogged soils in bottom panel 214.

A dishwasher appliance including a filter assembly 200 in accordance with an exemplary embodiment of the present disclosure may allow for more reliable operation, as filter assembly 200 may automatically purge or clean itself during operation. Such a filter assembly 200 may therefore require less maintenance and have a longer useful life.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, comprising:

a tub defining a wash chamber;

a sump positioned at a bottom portion of the tub along the vertical direction, the sump including a bottom wall defining a recessed chamber, the sump defining an axial direction;

a drain pump in flow communication with the recessed chamber of the bottom wall and including a drain pump impeller;

a filter assembly moveably positioned at least partially within the sump along the axial direction between a first position and a second position, the filter assembly spaced from the recessed chamber of the bottom wall of the sump along the axial direction when in the first position and seated on the bottom wall of the sump around the recessed chamber when in the second position;

a circulation pump including a circulation pump impeller, the circulation pump impeller positioned within the filter assembly; and a shaft extending through the drain pump impeller and to the circulation pump impeller, the shaft selectably engaged with the drain pump impeller and the circulation pump impeller.

2. The dishwasher appliance of claim 1, further comprising one or more biasing members configured to bias the filter assembly towards the first position.

3. The dishwasher appliance of claim 2, wherein the one or more biasing members include a spring positioned between the bottom wall of the sump and a bottom panel of the filter assembly.

4. The dishwasher appliance of claim 1, further comprising an electric motor, wherein the shaft is rotated by the electric motor.

5. The dishwasher appliance of claim 4, wherein the circulation pump further includes a first one-way clutch in mechanical communication with the circulation pump impeller and the shaft, wherein the drain pump further includes a second one-way clutch in mechanical communication with the drain pump impeller and the shaft, wherein the circulation pump impeller is rotated when the shaft is rotated in a first direction, and wherein the drain pump impeller is rotated when the shaft is rotated in a second direction.

6. The dishwasher appliance of claim 4, wherein when the circulation pump is activated the filter assembly is configured to be in the first position such that wash fluid flows inwardly through the side panel and bottom panel of the filter assembly.

7. The dishwasher appliance of claim 1, wherein when the drain pump is activated the filter assembly is configured to be in the second position such that wash fluid flows inwardly through the side panel of the filter assembly and outwardly through the bottom panel of the filter assembly.

8. The dishwasher appliance of claim 1, wherein the axial direction of the sump is parallel to the vertical direction, such that the first position of the filter assembly is an up position and the second position of the filter assembly is a down position.

9. A dishwasher appliance defining a vertical direction, comprising:

a tub defining a wash chamber;

a sump positioned at a bottom portion of the tub along the vertical direction, the sump including a bottom wall defining a recessed chamber, the sump defining an axial direction;

a drain pump in flow communication with the recessed chamber of the bottom wall for urging a flow of wash fluid from the sump when activated, the drain pump including a drain pump impeller;

a filter assembly positioned at least partially within the sump and movable along the axial direction between a first position and a second position, the filter assembly including a bottom panel, the bottom panel positioned over the recessed chamber of the bottom wall of the sump when the filter assembly is in the first position and seated on the bottom wall of the sump around the recessed chamber when the filter assembly is in the second position, a flow of wash fluid being reversed through at least a portion of bottom panel when the filter assembly is in the second position and the drain pump is activated;

a circulation pump including a circulation pump impeller, the circulation pump impeller positioned within the filter assembly; and a shaft extending through the drain pump impeller and to the circulation pump impeller, the shaft selectably engaged with the drain pump impeller and the circulation pump impeller.

10. The dishwasher appliance of claim 9, further comprising one or more biasing members configured to bias the filter assembly towards the first position.

11. The dishwasher appliance of claim 10, wherein the one or more biasing members include a spring positioned between the bottom wall of the sump and a bottom panel of the filter assembly.

12. The dishwasher appliance of claim 9, further comprising an electric motor, wherein the shaft is rotated by the electric motor.

13. The dishwasher appliance of claim 12, wherein the circulation pump further includes a first one-way clutch in mechanical communication with the circulation pump impeller and the shaft, wherein the drain pump further includes a second one-way clutch in mechanical communication with the drain pump impeller and the shaft, wherein the circulation pump impeller is rotated when the shaft is rotated in a first direction, and wherein the drain pump impeller is rotated when the shaft is rotated in a second direction.

14. The dishwasher appliance of claim 9, wherein when the circulation pump is activated the filter assembly is configured to be in the first position such that wash fluid flows inwardly through the side panel and bottom panel of the filter assembly.

15. The dishwasher appliance of claim 9, wherein when the drain pump is activated the filter assembly is configured to be in the second position such that wash fluid flows inwardly through the side panel of the filter assembly and outwardly through the bottom panel of the filter assembly.

16. The dishwasher appliance of claim 9, wherein the bottom panel of the filter assembly is circular in shape, and wherein the recessed chamber defined by the bottom wall of the sump defines an opening that is also circular in shape.

17. The dishwasher appliance of claim 16, wherein the bottom panel of the filter assembly defines a first diameter, wherein opening of the recessed chamber defined by the bottom wall of the sump defines a second diameter, and wherein the first diameter is larger than the second diameter.

18. The dishwasher appliance of claim 9, wherein the axial direction of the sump is parallel to the vertical direction, such that the first position of the filter assembly is an up position and the second position of the filter assembly is a down position.

19. A dishwasher appliance defining a vertical direction, comprising:

a tub defining a wash chamber;

a sump positioned at a bottom portion of the tub along the vertical direction, the sump including a bottom wall defining a recessed chamber, the sump defining an axial direction;

a drain pump in flow communication with the recessed chamber of the bottom wall and including a drain pump impeller;

a filter assembly positioned at least partially within the sump and above the recessed chamber along the axial direction;

a circulation pump including a circulation pump impeller, the circulation pump impeller positioned within the filter assembly;

an electric motor; and a shaft rotatable by the electric motor and extending through the drain pump impeller and to the circulation pump impeller, the shaft selectably engaged with the drain pump impeller and the circulation pump impeller, wherein the filter assembly is moveably positioned at least partially within the sump along the axial direction between a first position and a second position, wherein the filter assembly spaced from the recessed chamber of the bottom wall of the sump along the axial direction when in the first position and seated on the bottom wall of the sump around the recessed chamber when in the second position.

* * * * *